United States Patent [19]

Oogami

[11] 4,174,590

[45] Nov. 20, 1979

[54] LOWER FRAME FOR PIVOTED WINDOW

[75] Inventor: Eiryo Oogami, Kurobe, Japan

[73] Assignee: Yoshida Kogyo K.K., Japan

[21] Appl. No.: 862,647

[22] Filed: Dec. 20, 1977

[30] Foreign Application Priority Data

Dec. 21, 1976 [JP] Japan ..... 51-171315[U]

[51] Int. Cl.[2] ..... E06B 1/04

[52] U.S. Cl. ..... 49/504; 49/390

[58] Field of Search ..... 49/390, 471, 408, 504; 52/209

[56] References Cited

U.S. PATENT DOCUMENTS 3,383,815 5/1968 Smith, Jr. ..... 49/408 X 3,768,204 10/1973 Anderberg et al. ..... 49/390

FOREIGN PATENT DOCUMENTS 2624788 6/1976 Fed. Rep. of Germany ..... 52/209

*Primary Examiner*—Kenneth Downey

*Attorney, Agent, or Firm*—Hill, Van Santen, Steadman, Chiara & Simpson

[57] ABSTRACT

Disclosed is a structure of a lower frame for a pivoted window, which prevents intrusion of rain water into the room. The lower frame has a grooved section, and a rotation shaft is mounted on the bottom plate of the groove portion to support the pivoted window. Ventilation holes are formed in a space defined by the lower frame and a lower rail of the pivoted window so that the ventilation holes are communicated with outer air and generation of a negative pressure in the above-mentioned space is prevented.

4 Claims, 4 Drawing Figures

LOWER FRAME FOR PIVOTED WINDOW

BACKGROUND OF THE INVENTION

The present invention relates to a lower frame for a pivoted window disposed on an outer wall such as a curtain wall.

A window frame structure of a square or another shape is defined on an opening of an outer wall such as a curtain wall by frames and a pivoted window is generally attached to a supporting device disposed in the central portion of the space between the lower and upper frames of the window frame structure. Although air-tight means is mounted on a pivoted window of this type, leakage or intrusion of rain water into the room cannot be avoided because the space defined by the frames of the window frame structure and rails and stiles of the pivoted window is sealed from outer air and a difference of the pressure is produced between this space and outer air by changes of the pressue in outer air. Accordingly, it has been difficult to obtain a pivoted window having good water tightness.

OBJECTS OF THE INVENTION

It is therefore a primary object of the present invention to provide a lower frame for a pivoted window which can give an improved water tightness to the pivoted window and in which a rotation shaft supporting the pivoted window can easily be attached and the pivoted window can be fitted in good conditions. More specifically, the present invention provides a structure of a lower frame of a pivoted window in which the pressure of a space defined by the lower frame of the window frame structure and the lower rail of the pivoted window is kept equal to the pressure of outer air and rain water intruding in this space can be flown away to the outside promptly.

BRIEF SUMMARY OF THE INVENTION

In accordance with the present invention, there is provided a lower frame for a pivoted window, which has a top face having a grooved section, said lower frame comprising a rotation shaft disposed at the center of the bottom side of the grooved portion, ventilation holes formed at positions other than the position of said rotation shaft and a groove located in the lower portion of the bottom side of said grooved portion and opened to the outside, wherein a lower rail of the pivoted window is supported by said rotation shaft.

According to the present invention, the pivoted window is water-thghtly supported on the frames of the window frame structure, and the pressure of a space defined by an air-tight member mounted on the lower rail of the pivoted window and the groove of the lower frame of the window frame structure is kept equal to the pressure of outer air and a negative pressure is not generated in this space. Accordingly, occurrence of an undesirable phenomenon of intrusion of rain water into the room can be prevented.

According to the present invention, since ventilation holes are formed on the groove portion of the lower frame, rain water intruding into the groove portion can be flown away to the outside.

Still further, since another groove opened to the outside is formed in the lower portion of the bottom side of the grooved portion to face the lower rail of the pivoted window, the rotation shaft for supporting the pivoted window can easily be attached to or dismounted from the bottom side of the above-mentioned groove through this another groove.

DETAILED DESCRIPTION OF PREFERRED EMBODIMENTS

The present invention will now be described in detail by reference to the accompanying drawings.

Figure 1:
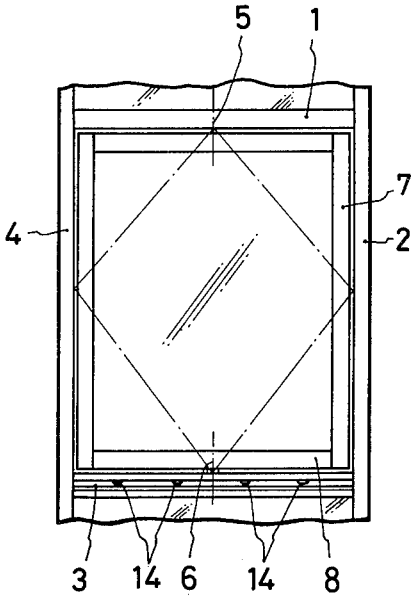
FIG. 1 is a front view, illustrating the relation between a pivoted window and a window frame structure supporting the pivoted window.

Referring to FIG. 1, a window fram structure is constructed by frames 1, 2, 3 and 4, and rotation shafts 5 and 6 are disposed in the central portion between the upper and lower frames 1 and 3. A pivoted window 7 is mounted so that it can rotate in the horizontal direction with the axial line connecting the rotation shafts 5 and 6 being as the center of the rotation.

The present invention relates to the structure including the above-mentioned lower frame 3 and the related lower rail of the pivoted window.

Figure 2:
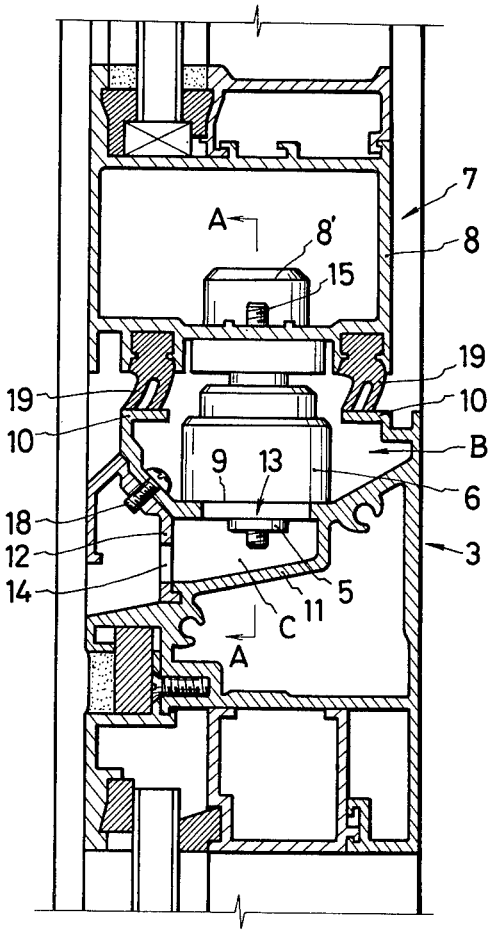
FIG. 2 is a lontigudinal sectional view, illustrating a lower rail of a pivoted window and a lower frame supporting the lower rail of the pivoted window in a first embodiment of the present invention.
Figure 3:
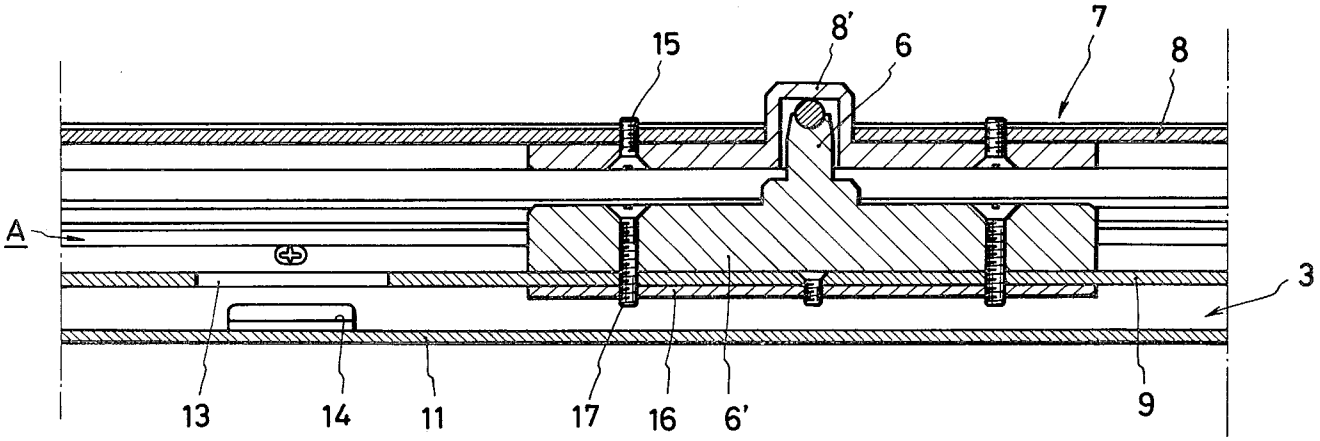
FIG. 3 is a view showing the section taken along the line A—A in FIG. 2.

FIGS. 2 and 3 illustrate a first embodiment of the present invention. In this embodiment, a projection 8' of a lower rail 8 of the pivoted window 7 is supported by the rotation shaft 6 and the pivoted window 7 is allowed to rotate in the horizontal direction with the above-mentioned axial line as the center of the rotation.

The lower frame 3 is gooved and it comprises a grooved bottom side 9 having a saucer-like section shape, lips 10 located above the grooved bottom side 9 and a grooved frame 11 located below the grooved bottom side 9. A supporting plate 12 is supported between a portion bulged from the grooved bottom side 9 toward the lip 10 and the grooved frame 11 by means of a screw 18 (FIG. 2).

Ventilation holes 13 are formed at positions other than the position of the rotation shaft 6 on the grooved bottom side 9, and another ventilation holes 14 are formed on the supporting plate 12.

As is seen from FIG. 3, a member having a projection 8' is fixed to the lower rail 8 of the pivoted window 7 from below the lower rail 8 by means of a screw 15. A supporting member 6' including the rotation shaft 6 is fixed in the central portion of the grooved bottom plate 9 of the lower frame 3 by clamping a backing plate 16 by means of a screw 17. Positions of the ventilation holes 13 may be registered with or slightly deviated from the positions of the ventilation holes 14 formed on the supporting plate 12.

As shown in FIG. 2, two air-tight members 19 composed of an elastic material are fitted on the lower face of the lower rail 8 of the pivoted window so that they fall in contact with the lips 10 of the lower frame 3, respectively, to keep water tightness. While the pivoted window 7 is in the closed state as shown in FIG. 2, a space B is formed between the grooved lower frame 3 and the lower part of the pivoted window 7 and in this state, water tightness is maintained between the lips 10 of the lower frame 3 and the pivoted window 7 by means of the air-tight members 19.

As described hereinbefore, the ventilation holes 13 are formed on the grooved bottom side 9 of the lower frame 3. Accordingly, this space B is communicated through these ventilaton holes 13 with a groove-like space C defined by the grooved frame 11 disposed below the grooved bottom side 9.

Since the ventilation holes 14 are also formed on the supporting plate 12 disposed sideward of the grooved frame 11 and the grooved bottom side 9, both the spaces B and C are communicated with outer air.

Figure 4:
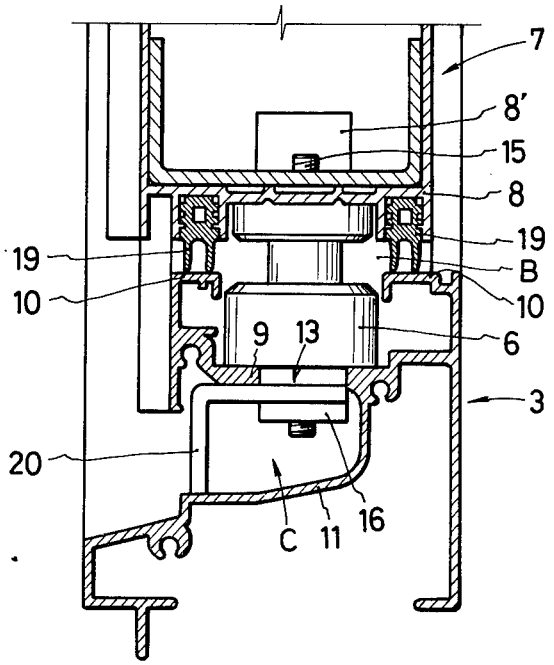
FIG. 4 is a longitudinal sectional view illustrating a lower frame for a pivoted window in a second embodiment of the present invention.

In a second embodiment of the present invention illustrated in FIG. 4, in the lower frame 3, a groove is defined by the lips 10 and the grooved bottom plate 9, and a groove frame 11 is formed below the grooved bottom plate 9, as in the first embodiment illustrated hereinbefore. However, this second embodiment is different from the first embodiment in the point that a supporting member 20 is disposed to support the grooved bottom side 9 on which the rotation shaft 6 is mounted. Since the side portion of this supporting member 20 is opened, the front face of the space C is communicated with outer air, and hence, also the space B connected to the space C is communicated with outer air.

The present invention is characterized in that a water-tight structure is provided between the lower rail 8 of the pivoted window 7 and the lower frame 3, a groove is formed in the upper portion of the lower frame 3 and a space B defined by the lower frame 3 and the pivoted window 7 is communicated with outer air. Accordingly, the pressure in the space B is always maintained at the same level as that of the pressure of the outer atmosphere, and therefore, occurrence of the phenomenon of intrusion of rain water into the room, which is caused by a negative pressure produced in the space B in the conventional arrangement, can be prevented. Further, water intruding in the space B can be promptly discharged to the outside. Moreover, since the space C opened to the outside is formed below the grooved bottom side 9 of the lower frame 3, the operation of attaching the rotation shaft 6 to the grooved bottom side 9 of the lower frame 3 or dismounting the rotation shaft 6 therefrom can be remarkably facilitated.

What is claimed is

1. A lower frame of a window frame structure for rotatably supporting a pivoted window in an opening defined by frames of the window frame structure, said lower frame having a top face confronting the pivoted window and having a first groove portion of a grooved section, and said lower frame comprising a second groove opened to the outside below said first groove portion, first means securing a pivoted window-supporting shaft in the central portion of the bottom side of said first groove portion confronting the pivoted window, said second groove being adapted by its opening to the outside to the dismounting of said pivoted window-supporting shaft at the bottom side of the first grooved portion and ventilation holes formed in said first groove portion so that said ventilation holes are communicated with said second groove opened to the outside.

2. A lower frame for supporting a pivoted window according to claim 1, wherein a generally vertical supporting wall member is attached to said second groove opened to the outside to thereby support the first grooved section.

3. A lower frame for supporting a pivoted window according to claim 2 wherein the supporting member has an opening therethrough to provide ingress and egress to said second groove and said first securing means.

4. A lower frame for supporting a pivoted window according to claim 2 wherein said supporting member is an L-shaped member having its vertical leg supported on said second groove and providing access therethrough to said first securing means for disassembly thereof and having its horizontal leg secured by said first securing means rigidly to said first groove portion.

* * * * *